US007708586B1

(12) United States Patent
Rohde et al.

(10) Patent No.: US 7,708,586 B1
(45) Date of Patent: May 4, 2010

(54) ILLUMINATED PANEL-MOUNT CONNECTOR RECEPTACLE

(75) Inventors: Daniel F. Rohde, Mechanicsburg, PA (US); Michael S. Feher, Steelton, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/360,523

(22) Filed: Jan. 27, 2009

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS

| | | | | |
|---|---|---|---|---|
| 5,619,801 | A | 4/1997 | Slates | |
| 5,690,509 | A * | 11/1997 | Eisenbraun | 439/490 |
| 5,790,041 | A * | 8/1998 | Lee | 340/815.45 |
| 6,048,218 | A | 4/2000 | Greenstein | |
| 6,165,006 | A | 12/2000 | Yeh et al. | |
| 6,350,160 | B1 | 2/2002 | Feuersanger et al. | |
| 6,457,992 | B2 | 10/2002 | Posey et al. | |
| 6,483,712 | B1 | 11/2002 | Oliphant et al. | |
| 6,572,402 | B2 | 6/2003 | Lin | |
| 7,137,743 | B2 | 11/2006 | Graham et al. | |
| 7,168,975 | B2 | 1/2007 | Kuo | |
| 7,194,183 | B2 * | 3/2007 | Thornton et al. | 385/139 |
| 7,238,057 | B2 * | 7/2007 | Baranowski | 439/668 |
| 7,247,046 | B1 | 7/2007 | Wu | |
| 7,429,188 | B2 | 9/2008 | Wu | |
| 7,448,919 | B2 * | 11/2008 | Baranowski | 439/668 |
| 2001/0027055 | A1 * | 10/2001 | Laity et al. | 439/490 |
| 2003/0194906 | A1 * | 10/2003 | Arkin et al. | 439/490 |
| 2006/0286856 | A1 * | 12/2006 | Sakamoto | 439/490 |
| 2009/0280677 | A1 * | 11/2009 | Gingrith, III | 439/490 |

OTHER PUBLICATIONS

"Glenair," ASAP Fiber Optic Cable Sets., Glenair, Inc., 1211 Air way, Glendale, CA, 91201-2497, 818-247-6000, FAX 818-500-9912, www.glenair.com, © 2006 Glenair, Inc., (2 pages).

* cited by examiner

*Primary Examiner*—Ross N Gushi

(57) ABSTRACT

An illuminated panel-mountable receptacle is disclosed. The receptacle body may be a translucent material and may be captivated to a panel by a front nut and a rear nut. A mounting nut is slotted so that the mounting nut may be threaded onto the rear portion of the receptacle body even when a cable has already been connected thereto. The mounting nut is configured to receive a light guide so that a source of illumination can be provided at a back portion of the receptacle and propagate through the receptacle so as to illuminate the receptacle when viewed by a user.

28 Claims, 5 Drawing Sheets

ILLUMINATED PANEL-MOUNT CONNECTOR RECEPTACLE

TECHNICAL FIELD

The present application relates to an illuminated panel-mounted cable interface.

BACKGROUND

External connections to electrical, electronic and optical equipment may be made using mating connectors. An external cable, which may be an electrical cable of conductive wires, an optical cable having optical fiber transmission paths, or a combination of such techniques, may mate with the equipment using a panel mounted interface part. The terminology used to describe the mating parts varies; however, the terms "jack" and "plug" corresponding to "female" and "male" parts is often used. Alternatively the term "receptacle" is used instead of jack. Examples of hermaphrodite connector types are also known.

Panel-mounted plugs or jacks may be illuminated so as to indicate the status of a connection, or to aid in orienting and mating the plug and the jack. The illumination is often provided by a light emitting diode (LED) that is an integral part of the design of the panel-mounted receptacle. Where the LED is remotely located, light may be guided by a light guide or light pipe; however such components are part of the connecting cable assembly and are not separately provided. Where the plug is illuminated, the light is guided by a light pipe in a substantially opaque jack and transmitted to the plug when the plug and the jack are mated.

Illuminated receptacles may find a use in medical or other applications where connections to equipment need to be made in low-ambient-light operation. Such illuminated receptacles may have illumination controllable to indicate the status of a connection or the function of the connection.

Illuminated connectors such as described in U.S. Pat. No. 6,457,992 to Posey et al. have integral light emitting diode (LED) light sources that may be used to indicate a status of operations conducted by or with an associated circuit. Similarly, U.S. Pat. No. 6,572,402 to Lin describes a connector where the electrical signal strength or status is indicated by an external ring portion of the connector and the illumination is provided by LED elements that are a part of the connector assembly.

U.S. Pat. No. 7,194,183 to Thornton et al. describes a connector receptacle where the light from an LED source is coupled to the receptacle by a light pipe, the light pipe being disposed to radiate the light from the receptacle onto the leading edge of a plug, when the plug is disposed within the receptacle.

SUMMARY

A device for installation in a panel is disclosed, having a connection portion configured to have an interface with a mating detachable device. The connection portion is adapted to be captivated to the panel, and further configured to terminate a cable at an end thereof opposite to the interface with the mating detachable device. A coupling, attachable to the connection portion is adapted to receive a light guiding element so that a terminating end of the light guiding element may be disposed to face a surface of the connection portion. The coupling is configured so as to be mounted to the connection portion when the connection portion has been mounted to the panel, without passing the cable through the coupling.

The connection portion may be a connector receptacle having a body with a substantially circular cross section. The body may be threaded along at least a portion of an exterior surface of the body. A first nut may be attachable to a first end of body, and a second nut may be threadable onto the body so as to be capable of captivating the body to an aperture in a panel. The coupling may be a mounting nut attachable onto a second end of the body and have a channel formed therein so as to permit passing the mounting nut over a cable attached to the second end of the body without passing the cable through the mounting nut along a length thereof. The body may be capable of transmitting light impinging on the second end thereof.

A mounting nut is disclosed, the nut having a body with a length and having a cylindrical recess extending a first distance into the body from a first surface. A slot may be formed along a length of the body, wherein the slot extends a second distance into the body from a side surface, and the body has a through hole extending from a second surface.

In an aspect, a method of illuminating a receptacle includes providing a panel-mountable receptacle and a mounting nut, the mounting nut attachable to the panel-mountable receptacle. The mounting nut may be configured so as to permit attachment of the mounting nut to the panel-mountable receptacle after a cable has been installed to the panel-mountable receptacle, without threading the cable along an axis of the mounting nut. The mounting nut may have a through-hole sized and dimensioned to accept a light guide.

BRIEF DESCRIPTION OF THE DRAWINGS

FIG. 5 (B) is a cross section view thereof along a centerline; and, FIG. 5 (C) cross section view thereof through the light-guide-insertion through-hole.

DETAILED DESCRIPTION

Exemplary embodiments of the invention may be better understood with reference to the drawings, but these embodiments are not intended to be of a limiting nature. Like numbered elements in the same or different drawings perform equivalent functions. When a specific feature, structure, or characteristic is described in connection with an example, it will be understood that one skilled in the art may effect such feature, structure, or characteristic in connection with other examples, whether or not explicitly stated herein.

A panel-mountable device, which may be a panel mounted receptacle assembly, may be illuminated by directing light to a rear portion thereof. The light propagating within the receptacle may be refracted or scattered so as to exit the receptacle assembly in a direction such that a user may view an illuminated region where a plug may mate with the receptacle assembly.

Figure 1:
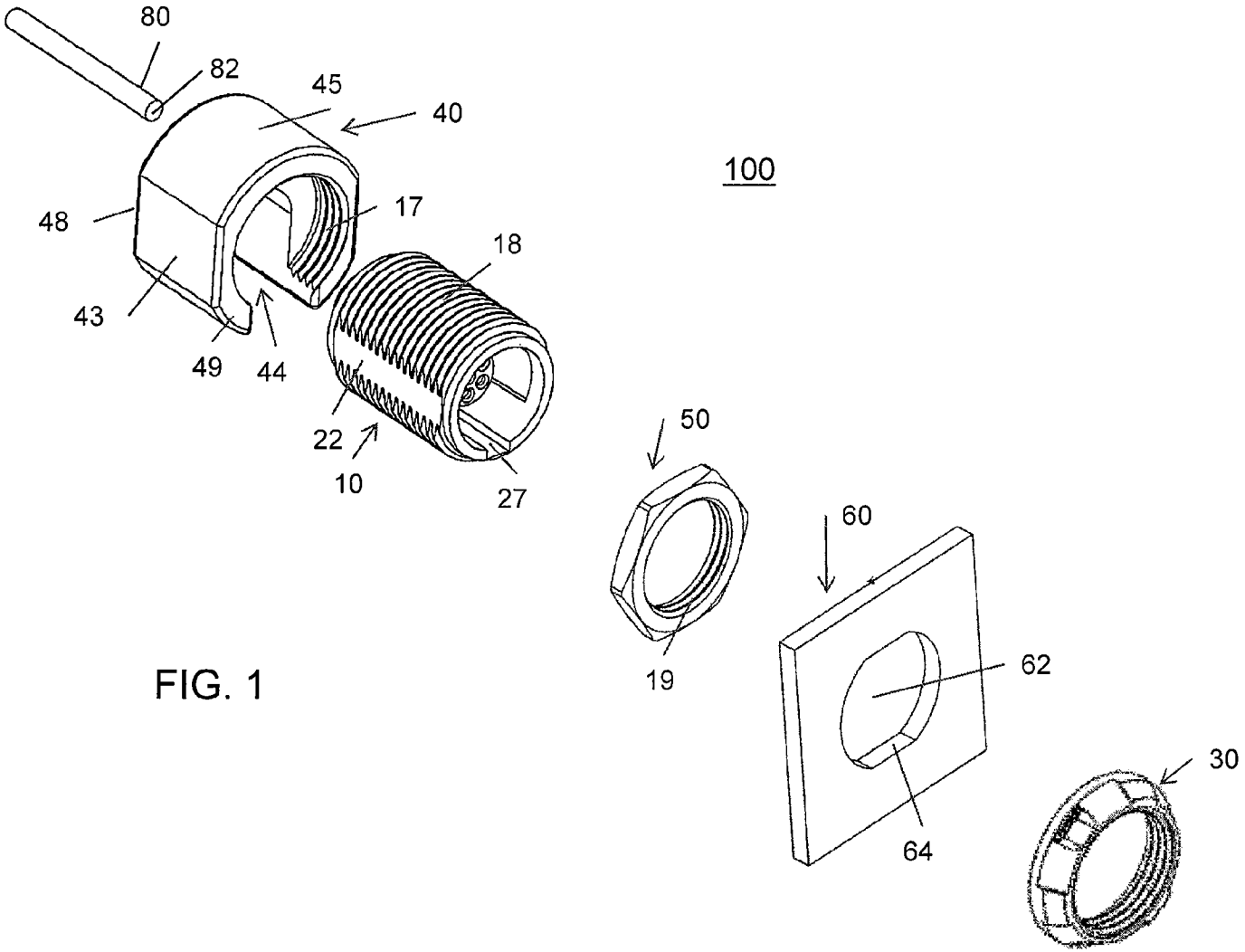
FIG. 1 is an exploded perspective view of an example of an illuminated receptacle assembly, including a portion of a panel to which the receptacle assembly may be mounted.

FIG. 1 shows a front-side perspective view of the components of a panel mounted receptacle assembly 100, the panel 60 and a light guide 80, a connection portion, which may be the receptacle body 10 being mountable to the panel 60. An aperture 62 is formed in the panel 60, and may have one or more flat segments 64, so as to engage with a corresponding flat portion 22 on the receptacle body 10 and restrain the receptacle body 10 from rotating in the aperture 62 when a torsional force is applied, for example, by a manipulation of an inserted mating detachable device, such as a plug.

A front nut 30 may be attached to the end of the receptacle body 10 which is intended to be accessible by the user when the receptacle body 10 is mounted to the panel 60. The front nut 30 may be attached to the body 10 by threading, molding, or the like. The receptacle body 10, having the front nut 30, may be captivated to the panel 60 by a nut 50, having internal threads 19, which may be threaded onto the threads 18 of the receptacle body 10 to draw the nut 30 against the panel 60.

A keyway 27 may be provided so as to assist in aligning the pins of a plug (not shown) with the receiving parts of the receptacle body 10.

A mounting-nut 40 may be threaded onto the end of the receptacle body 10 distal from the front nut 30, by engaging the threads 17 thereof with the threads 18 of the receptacle body 10. The mounting nut 40 may have a channel 44 formed therein extending from a front surface 48 to a rear surface 49 thereof, so the mounting nut 40 may be threaded onto the rear portion of the receptacle body 10, without passing the mounting nut 40 nut along an installed electrical cable 70 or conductors which may have been attached to the rear portion of the receptacle body 10. The mounting nut 40 may have a flat portion 43 to facilitate gripping the mounting nut 40 when threading the mounting nut 40 onto the rear of the receptacle body 10.

Alternatively, the mounting nut 40 may be configured so as to slideably engage the flat segments 22 of the body 10.

A light guide 80, which may be any structure capable of guiding light from a source of illumination (not shown), without substantial loss or leakage, may be used to guide illuminating light. The light guide 80 may be a plastic rod, which may be flexible, an optical fiber, or a bundle thereof formed into a cable. Often the light guide is further enclosed in a jacket or sheath for physical protection, or to limit the incidental emission of the light along the guided path. In an aspect, the plastic rod or fiber may be a polymeric optical fiber (POF) made of PMMA (polymethyl methacrylate), polycarbonate (PC), or polystyrene (PS). Alternatively, the light guide may be an optical fiber made of silica or other transparent material, or be a light pipe.

Figure 2:
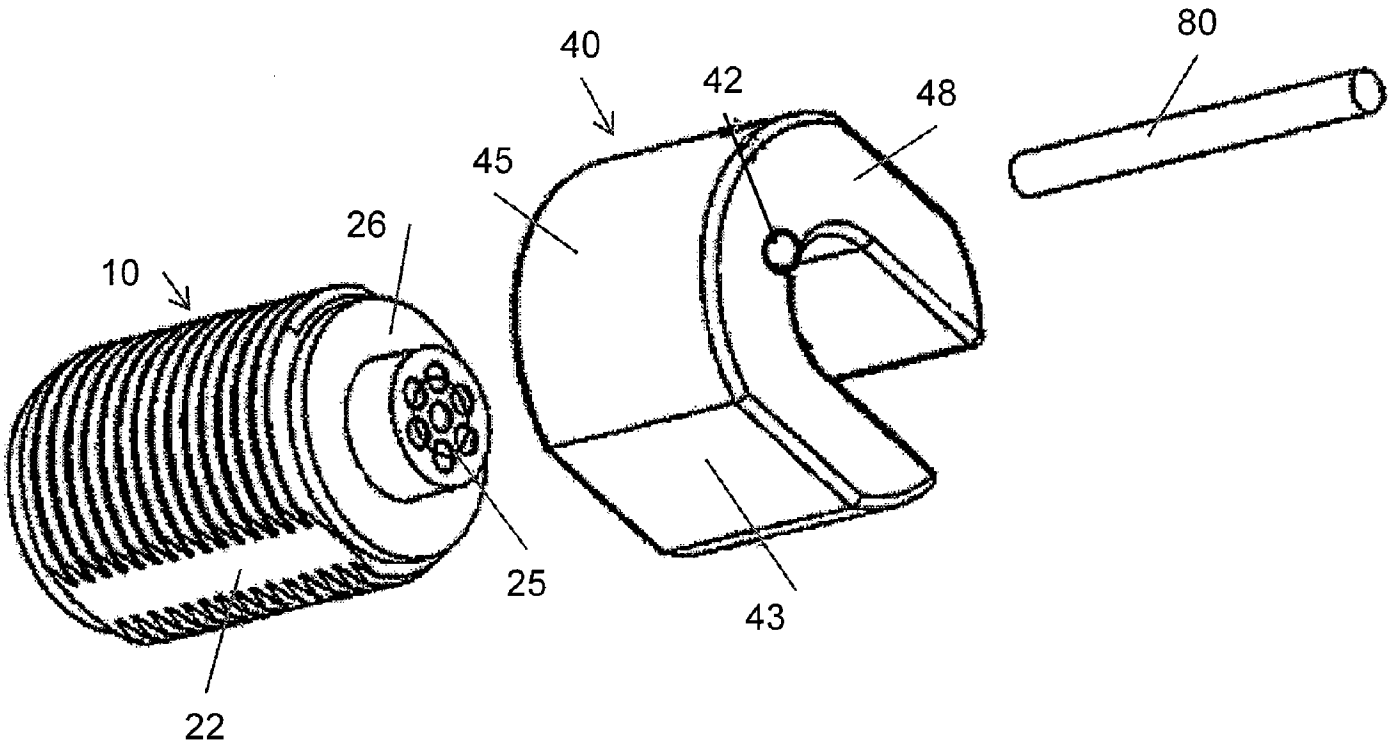
FIG. 2 shows an exploded side-rear perspective view of a portion of the receptacle, also showing a light guide.

As shown in FIG. 2, the light guide 80 may be oriented so as to be insertable into a light-guide-receiving through-hole 42 formed in the mounting nut 40, from the front surface 48 of the mounting nut 40. The through-hole 42 may penetrate from the front surface 48 to a location permitting light exiting from an end of an inserted light guide 80 to impinge on a rear surface 26 of the receptacle body 10 when the mounting nut 40 is installed to the receptacle body 10.

The receptacle body 10 may also have one or more longitudinal tubes 25 formed therein so as to accommodate metallic structures for making electrical connections.

Figure 3:
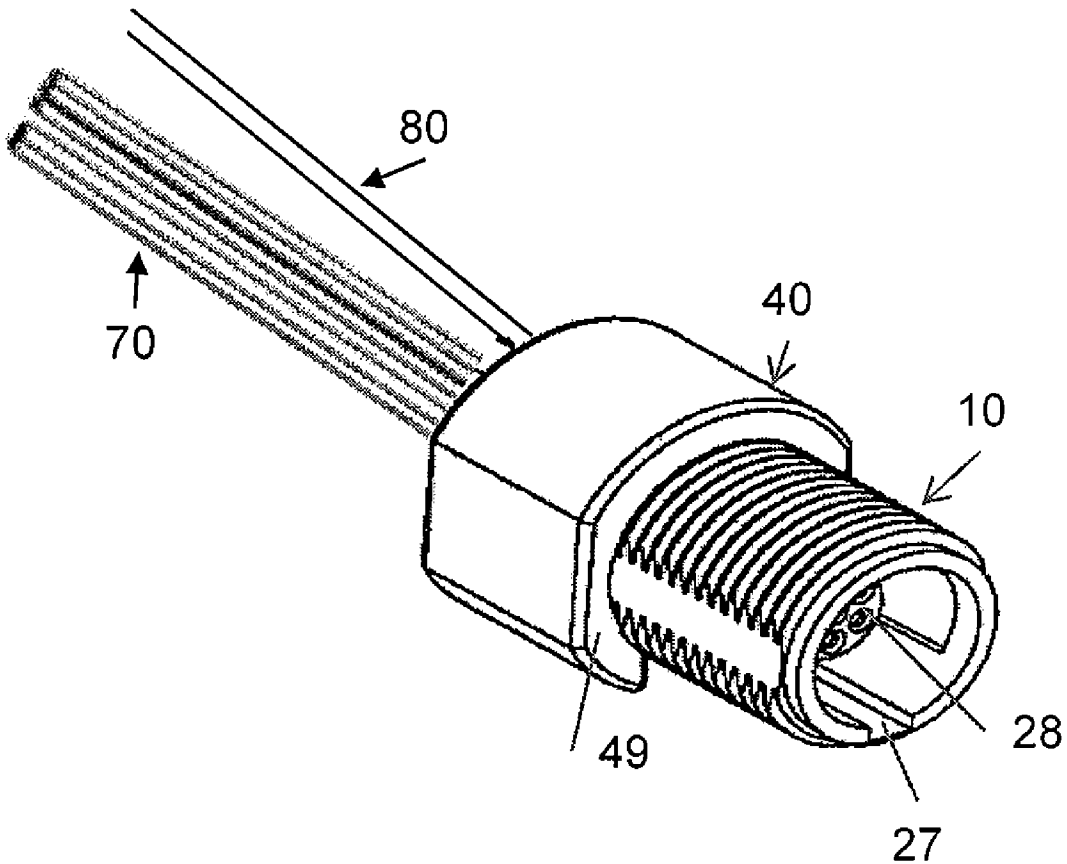
FIG. 3 shows an front-side view of a portion of the receptacle body with the light guide inserted in a mounting nut.

FIG. 3 shows the receptacle body 10 with the mounting nut 40 assembled thereto. The light guide 80 is at the rear, as well as any electrical conductors or cable 70 that may have been attached to metallic structures inserted in the tube 25, the front ends 28 of which may be seen recessed into the front of the receptacle body 10.

Figure 4:
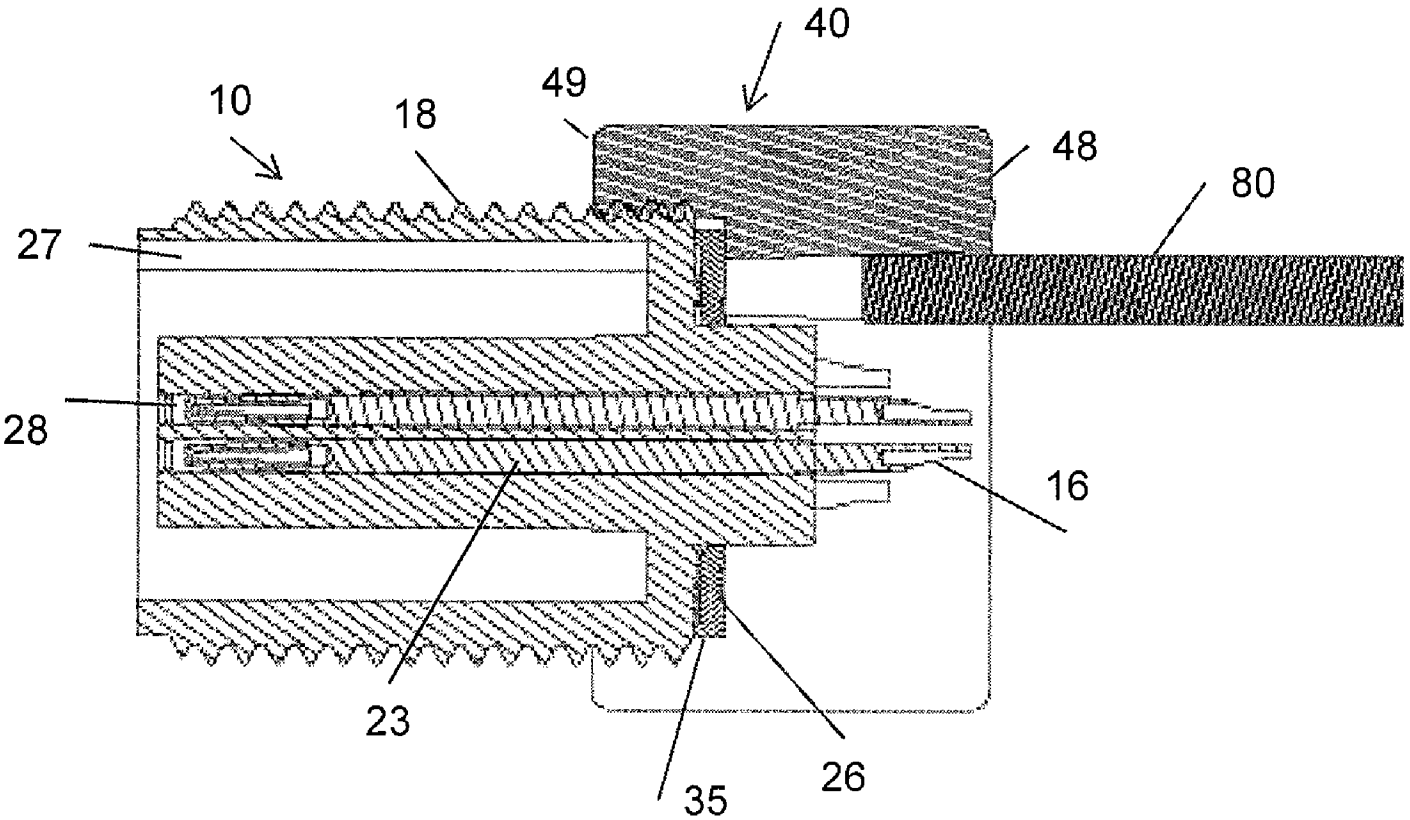
FIG. 4 is a cross section of the receptacle body showing a mounting nut with a light guide inserted therein.

In a cross sectional view, FIG. 4, the receptacle body 10 is shown with the metallic structures 23 inserted into the tubular holes 28 extending from the front to the back of the receptacle body 10. The mounting nut 40 and the light guide 80 are also shown. The metallic structures 23 may have solder cups 16 formed at the rear end thereof so as to accommodate wires of the cable 70, attachable by a soldering process. Other means of termination of wires to the metallic structures 23 such as swaging, crimping, or the like, are known and may equivalently be used.

The mounting nut 40 is shown threaded onto the receptacle body 10, and a light guide 80 inserted into the through hole 42. The assembly sequence process may be that the electrical connections may be made by soldering wires to the solder cups 16, the receptacle body 10 captivated to the panel 60, by the front nut 30 and the nut 50, and the mounting nut 40 subsequently threaded onto the receptacle body 10. The assembly of the receptacle body 10 to the panel 60, using the front nut 30 and the nut 50, and the connection of a cable to the rear portion of the receptacle body 10, may be performed prior to assembling the mounting nut 40 to the rear of the receptacle body 10. This is possible as the mounting nut 40 has a channel 44 so as to permit the mounting nut 40 to be placed over a cable 70, which may already be in place, without having to pass the cable 70 through the mounting nut 40 from the front surface 48 to the rear surface 49 thereof, along the axis of the mounting nut 40. The mounting nut 40 may be placed over the cable 70 so that the cable 70 passes into the channel 44 from a side of the mounting nut 40. At this point in the assembly process, the cable 70 may have been already attached at an end thereof distal from the receptacle 10. Other assembly processes and sequences are also possible and may be used.

A front face 82 of the light guide 80 may be spaced apart from the rear surface 26 of the receptacle body 10, or be in contact therewith, depending on the relative diameter of the light guide 80 and the through-hole 42 in the mounting nut 40. When the front face 82 of the light guide 80 does not directly contact a portion of the rear (26 or 35) of the receptacle body 10, the light may be radiated from the front end 82 of the light guide 80 and enter the rear surface of the receptacle body 10. Where the light guide 80 is in contact with the receptacle body 10, the transmission of light may be directly from the light guide 80 to the receptacle body 10.

In an aspect, a light-transmitting washer 35 may be affixed to the rear portion of the receptacle body 10 by gluing, thermal welding, or other similar process. The washer 35 may serve to close off any orifices in the rear portion of the receptacle body 10 that may have been needed in the manufacturing operation. In addition, the washer 35 may have a color so as to impart a color to the light received from the light guide 80. A color code may be used to provide further guidance to the user by color coding the illumination that may be observed at the front of the receptacle body 10, which may be viewed from the front of the panel 60, when the receptacle assembly 100 has been installed. For this purpose, a broad-spectrum light source may be provided. Such sources may be semiconductor materials, incandescent lights, electrical discharge lights, or the like. Alternatively, the washer 35 may be transparent, and the color provided by the spectrum of the light source, which may be, for example, a light emitting diode (LED). The light guide 80 may be fixed to the mounting nut 40 using an adhesive.

An electrical connector is shown in FIG. 4, where a plurality of wires may be soldered to solder cups 16 at the rear of the receptacle 10. Alternatively, the wires may be terminated fixtures that may be inserted into the holes 25 of the receptacle 10, and positioned so as to engage pins (not shown) of the plug.

Figure 5:
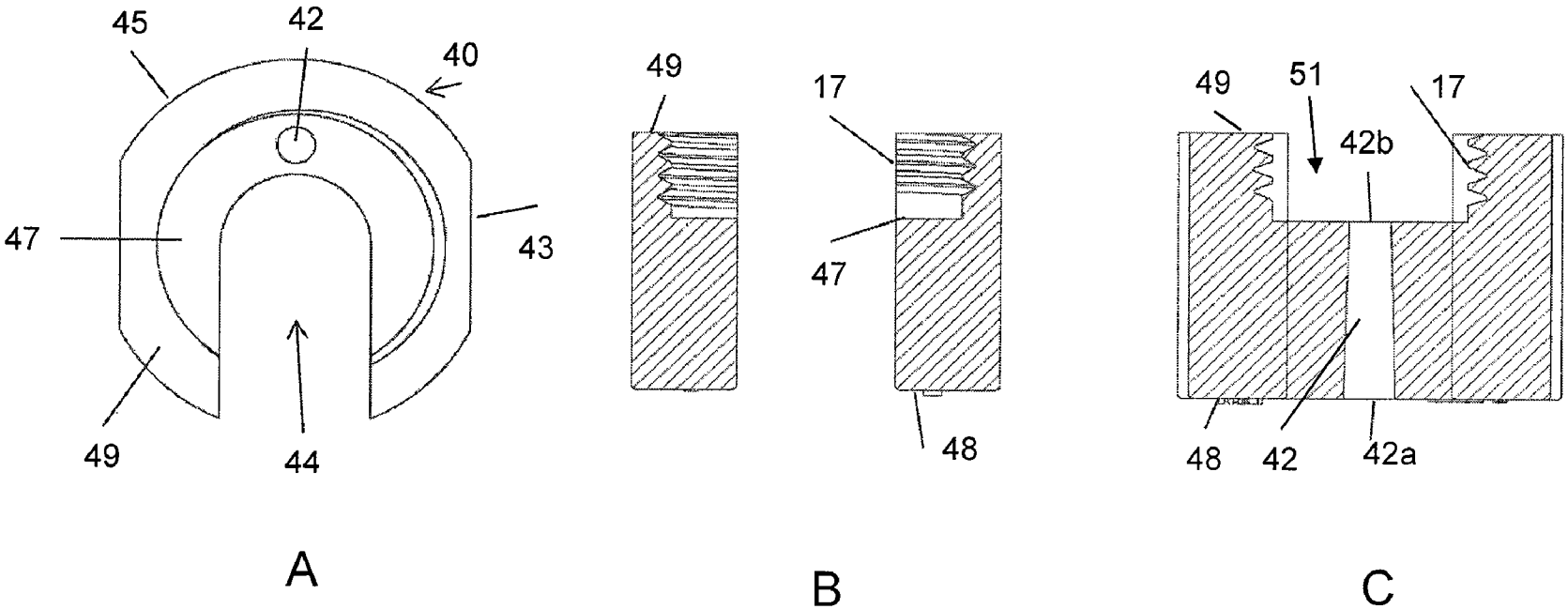
FIG. 5 (A) is an end view of the mounting nut.

The structure of the mounting nut 40 may be seen in FIG. 5. The mounting nut 40 may be the form of a substantially circular cylinder. Other external shapes such as square, hexagonal, or the like may be equally possible. An aperture 51 may be formed in a rear surface 49 and extend partially along a length of the mounting nut body. The aperture 51 may be threaded with a thread 17, complimentary to that of the receptacle body 10, so that the mounting nut 40 may be threaded onto the receptacle body 10. The rear surface 26 of the receptacle body may contact, or come into close proximity with, a facing surface 47 of the interior of the aperture 51 in the mounting nut 40 when the mounting nut 40 is threaded onto the receptacle body 10. A flat portion 43 may be formed on the surface 45 of the mounting nut 40 to facilitate gripping the mounting nut 40 when threading the mounting nut 40 onto the receptacle body 10.

A slot 44 may be formed in a side surface 45 of the mounting nut body, extending along the length of the mounting nut body, and extending inwards from the side surface 45 so as to provide a path for the wires 70, a cable, or the like, from the rear surface 49 to the front surface 48 of the mounting nut 40. The front surface 48 of the mounting nut 40, being the surface distal from the panel 60 when the mounting nut 40 is threaded onto the receptacle body 10, has a light-guide receiver 42 which is a through-hole, substantially perpendicular to the front surface 48, and extending from the front surface 48 to an interior facing surface 47. The light guide receiver 42 may have a transverse dimension at the end 42*a* proximal to the front surface 48 that is greater than the transverse dimension at the end 42*b* proximal to the interior facing surface 47. The tapered dimensional shape of the through hole 42, which may be seen in FIG. 5C, may provide for an interference fit between an exterior surface of the light guide 80 and the interior of the light guide receiver 42, along a portion of the length thereof, so as to provide a means of securing the light guide 80 to the remainder of the assembly. Such an interference fit accommodates a variety of diameters of the light guide 80, but the interference fit is not essential, as the light guide 80 can be secured to the mounting nut 40 by an adhesive, so as to prevent pull-out after installation. Whether an interference fit is achieved, and the depth to which the light guide 80 is insertable into the through hole 42, depends on the relative cross-sectional dimensions of the light guide 80 and the through hole 42. A through hole 42 having a constant cross sectional dimension may also be used. In an aspect, the through hole 42 may be a channel.

In an aspect, the receptacle body 10 may be formed with an integral front nut or flange instead of, or in addition to, the threaded nut 30.

In another aspect, the plug and receptacle assembly may terminate an optical fiber, such as may be used for data communications, or a light guide. Receptacles for other purposes, such as fluidics, may be illuminated in a similar manner. In such applications, the term "cable" would be understood to mean a light wave structure such as an optical fiber or light pipe, or a tube for containing a fluid.

The mounting nut 40 may thus be installed after the installation of the receptacle body 10 to the panel 60 during the construction of the equipment with which it is associated. The receptacle body may have been connected to the cable 70 in a manufacturing step that may include the fabrication of a cable harness where the cable lengths are determined so that a plurality of receptacles, which may include the receptacle body 10. The mounting nut 40 and an optical guide 80 may be installed in another manufacturing step from that of the cable harness. In an aspect, the light guide 80 may be included in the cable harness and routed to each of the receptacles 10 that is to be illuminated. The light guide 80 may be installed in the mounting nut 40 after the receptacle 10 has been installed in the panel 60. Each of the light guides 80 may be connected to a separate light source, or a plurality of light guides may be connected to a single light source, providing for design flexibility. In addition, the repair of the equipment is facilitated by permitting the light sources to be replaced without removing the receptacle 10 from the panel. This may be useful in medical equipment, where the seal between the receptacle 10 and the panel 60 may constitute a performance requirement.

The receptacle body 10, or a portion thereof, may be molded from a light transmitting material such as a transparent or translucent plastic which may be a polycarbonate; for example, LEXAN, ULTRM (PEI) (both available from Sabic Innovative Plastics, Niskayuna, N.Y.), or the like. The mounting nut 40 may be molded from VALOX (PBT), (available from Sabic Innovative Plastics), or other suitable material.

Although the present invention has been explained by way of the examples described above, it should be understood to the ordinary skilled person in the art that the invention is not limited to the examples, but rather that various changes or modifications thereof are possible without departing from the spirit of the invention. Accordingly, the scope of the invention shall be determined only by the appended claims and their equivalents.

What is claimed is:

1. A device for installation in a panel, comprising:

a connection portion configured to have an interface with a mating detachable device, the connection portion adapted to be captivated to the panel, and further configured to terminate a cable at an end thereof that is opposite to the interface with the detachable mating device; and a coupling adapted to receive a light guiding element and position a terminating end of the light guiding element to face a surface of the connection portion;

wherein the coupling is configured to be mounted to the connection portion when the connection portion has been mounted to the panel, without passing the cable through the coupling.

2. The device of claim 1, wherein the connection portion has a body having a substantially circular cross section, the body being threaded along at least a portion of an exterior surface thereof.

3. The device of claim 2, wherein the coupling has a channel formed therein, extending along a length thereof.

4. The device of claim 1, wherein a first nut, a second nut and the coupling are threaded so as to be complimentary to the connection portion.

5. The device of claim 4, wherein the connection portion is captivated to the panel by the positioning the first nut and the second nut so that the panel is disposed therebetween when the first nut and the second nut are threaded onto the connection portion.

6. The device of claim 1, wherein the connection portion is capable of transmitting light impinging on a first surface thereof, such that the light is viewable at a second surface of the connection portion, the second surface disposed on an opposite side of the panel from the coupling.

7. The device of claim 6, wherein a light transmitting portion of the connection portion is a translucent material.

8. The device of claim 6, wherein a light transmitting portion of the connection portion is a transparent material.

9. The device of claim 1, wherein the connection portion has a color.

10. The device of claim 1, wherein the coupling has a through-hole.

11. The device of claim 10, wherein the through-hole is tapered so as to form an interference fit with the received light guiding element.

12. The device of claim 1, wherein the coupling portion is a receptacle suitable for receiving a plug.

13. The device of claim 12, wherein the plug is a male electrical connector.

14. The device of claim 12, wherein the receptacle is configured to mate with a plug.

15. The device of claim 12, wherein the receptacle is a fiber optic connector.

16. The device of claim 12, wherein the receptacle is configured to mate with a fiber optic connector.

17. The device of claim 1, further comprising a light transmitting washer disposable between the surface of the connection portion and the coupling.

18. The device of claim 17, wherein the light transmitting washer is affixed to the surface of the connection portion.

19. A mounting nut, comprising:

a body having a length;

a recess extending a first distance into the body along the length from a first surface thereof;

a slot formed along the length of the body, the slot extending a second distance into the body from a side surface thereof; and a through hole, substantially perpendicular to a second surface of the body.

20. The mounting nut of claim 19, wherein the first distance is less than the length of the body.

21. The mounting nut of claim 19, wherein the recess is threaded along at least a portion of the first distance.

22. The mounting nut of claim 19, wherein the second distance is greater than half of a cross sectional dimension.

23. The mounting nut of claim 19, wherein the body has a substantially circular cross section transverse to the length thereof, and a flat portion is formed on the circular cross section along at least a part of the length of the body.

24. The mounting nut of claim 19, wherein the through-hole is tapered along a length thereof.

25. The mounting nut of claim 19, wherein the through-hole is sized and dimensioned to receive a light guide.

26. The mounting nut of claim 19, wherein the through-hole is sized and dimensioned to effect an interference fit with an insertable light guide.

27. The mounting nut of claim 19, wherein the through hole is a channel.

28. A method of illuminating a receptacle, the method comprising:

providing a panel-mountable receptacle; and providing a mounting nut, attachable to the panel-mountable receptacle, the mounting nut being configured so as to permit attachment of the mounting nut to the panel-mountable receptacle after a cable has been installed to the panel-mountable receptacle, without threading the cable along an axis of the mounting nut, wherein the mounting nut has a through-hole sized and dimensioned to accept a light guide.

* * * * *